United States Patent [19]

Tokitou et al.

[11] 4,358,533

[45] Nov. 9, 1982

[54] SILVER HALIDE PHOTOGRAPHIC MATERIAL

[75] Inventors: Kouji Tokitou, Hachioji; Tsuneo Wada, Sagamihara, both of Japan

[73] Assignee: Konishiroku Photo Industry Co., Ltd., Japan

[21] Appl. No.: 242,490

[22] Filed: Mar. 11, 1981

[30] Foreign Application Priority Data

Mar. 11, 1980 [JP] Japan ..... 55/31150

[51] Int. Cl.[3] ..... G03C 1/72; G03C 1/06; G03C 5/26

[52] U.S. Cl. ..... 430/512; 430/510; 430/517; 430/527; 430/531; 430/536; 430/537; 430/539; 430/543; 430/546; 430/564; 430/566; 430/570; 430/606; 430/627; 430/957

[58] Field of Search ..... 430/377, 627, 493, 546, 430/635, 637, 631, 564, 566, 570, 536, 537, 510, 512, 517, 539, 531, 507, 606, 957

[56] References Cited

U.S. PATENT DOCUMENTS

| | | | |
|---|---|---|---|
| 2,304,940 | 12/1942 | Mannes et al. | 430/549 |
| 2,322,027 | 6/1943 | Jelley et al. | 430/546 |
| 2,801,171 | 7/1957 | Fierke et al. | 430/546 |
| 3,619,195 | 11/1971 | Van Campen | 430/546 |
| 4,247,627 | 1/1981 | Chen | 430/517 |

FOREIGN PATENT DOCUMENTS

| | | | |
|---|---|---|---|
| 56-19043 | 2/1981 | Japan | 430/627 |
| 56-19047 | 2/1981 | Japan | 430/627 |

OTHER PUBLICATIONS

Research Disclosure, No. 15930, dated Jul. 1977.

*Primary Examiner*—Mary F. Downey
*Attorney, Agent, or Firm*—Finnegan, Henderson, Farabow, Garrett & Dunner

[57] ABSTRACT

A silver halide photographic material having a hydrophilic colloid layer comprising fine polymer particles loaded with a hydrophobic photographic addenda provided on a support wherein the polymer has repeating units formed from a nonionic hydrophobic monomer. The nonionic hydrophobic monomer has the formula

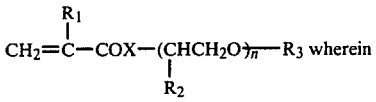

X is —O— or —N(R4)—, R4 is an alkyl group or —(CH(R4)CH2O)m—R3, $R_1$ and $R_2$ individually are a hydrogen atom or methyl group, $R_3$ is a hydrogen atom, an alkyl or aryl group, and m and n are integers of from 2 to 100 individually.

7 Claims, No Drawings

SILVER HALIDE PHOTOGRAPHIC MATERIAL

The present invention relates to a silver halide photographic material containing a hydrophobic compound uniformly dispersed in a hydrophilic layer, and particularly to one in which the hydrophobic compounds are loaded in fine particles of polymer.

There have heretofore been used in the manufacturing process of silver halide photographic materials some methods for uniformly dispersing various kinds of hydrophobic compounds,—particularly such non-polymer compounds as dye formers, ultraviolet absorbing materials and the like. One of these methods is such that a solid or liquid hydrophobic compound (I) is mixed with a hydrophobic colloidal solution (II), and the resulting mixture is passed several times through a high energy mill such as a colloid mill thereby to disperse mechanically (I) into (II) to make a dispersed liquid, which is then dispersed into a hydrophilic colloidal liquid. However, this method is prone to produce an unsatisfactorily dispersed liquid which may sometimes be unstable. Further, this method needs a large amount of energy in order to make (I) as minute and dispersed as is desired. Such consumption of a large amount of energy is sometimes accompanied by an accumulation of heat or undesirable local heating, thus becoming the cause of undesirable chemical change of the contained components.

Another method for dispersing a hydrophobic compound into a hydrophilic colloidal liquid as described in U.S. Pat. Nos. 2,304,940 and 2,322,027 is such that a hydrophobic compound is dissolved in an oil or a high boiling solvent, and the resulting oily solution is then dispersed into a hydrophilic colloidal liquid. A modification of this method is described in, for example, U.S. Pat. No. 2,801,171, which uses a low molecular auxiliary solvent such as ethylacetate or low molecular ketone which helps dissolve a hydrophobic compound in an oily solvent. In the manufacture of a silver halide color photographic emulsion into which is incorporated a ballasted color former compound, there is widely applied such a method that a ballasted coupler is dissolved in an oily high boiling solvent called the color former solvent, and the resulting solution is then dispersed into a hydrophilic colloidal solution such as silver halide gelatin emulsion. However, even in such a method for the dispersion of a color former solution a high energy pulverizing process is necessary in order to obtain as much satisfactory a dispersion and particle size as desired, which high energy usually causes an undesirable deterioration such as heat decomposition of some component in the pulverized composition. Besides, such a pulverizing process requires not only a long period of time but a high cost. Thus, there has long been called for an improvement of the method capable of uniformly dispersing a hydrophobic compound such as ballasted dye formers and the like into a photographic emulsion or other hydrophilic colloidal liquids. In such an improved method, the use of a high energy mill for the dispersion of a hydrophobic material into a hydrophilic colloid-containing composition must be eliminated.

U.S. Pat. No. 3,619,195 discloses the use of a water-insoluble but organic solvent-soluble polymer in the dispersion of a hydrophobic coupler for the purpose of improving a photographic characteristics (e.g., image perservability). According to this art the use of a high energy mill is needed for the emulsification of a coupler containing polymer. Chen Research Disclosure, No. 15930, 7/1977 discloses that polymer particles in a polymer latex are loaded with a hydrophobic compound, and resulting loaded polymer particles are dispersed in a hydrophilic layer, without making use of a high energy dispersing machine such as a colloid mill. The use of the polymer latex provides the resulting silver halide photographic material with some favorable characteristics such that the particle size of the dispersoid containing the loaded coupler is smaller than that of those emulsions obtained by the application of conventional methods, whereby not only the sharpness of images but the reaction of developers with a coupler are improved. Hydrophobic compounds, notwithstanding the incorporation thereof had been desired, have not been permitted to be incorporated because of a proneness to be oxidized. Such compounds may, however, be incorporated by this method thereby providing a significant resistance to oxidation, and thus the compounds have become permitted to be introduced in dispersal liquids. In addition, such a hydrophobic material, so highly reactive that, e.g., it reacts with other components in a photographic layer, is permitted to be incorporated by the use of polymer latex because the latex restricts the reactivity. Thus the use of a polymer latex as a dispersing carrier of hydrophobic photographic additives eliminates the use of a high energy mill and is an art that is capable of providing excellent photographic characteristics as mentioned above, but there may be pointed out some problems to be solved lying in the art: In the case of applying the method of the foregoing inventions, the method requires a relatively large amount of water-miscible organic solvents; requires a large-scale device for removing the solvent, and also requires a considerable period of time to remove the solvent. Besides, the usable kinds of polymers are considerably narrowly limited, and the polymer latex impregnated with the thus obtained hydrophobic compound cannot necessarily be fully stable.

As the polymer latex applicable to the dispersion of hydrophobic materials in the foregoing inventions, cationic or anionic monomers are used as essential components. Whereas these monomers have such an advantage that they are not aggregated in solvents that are employed when impregnating hydrophobic materials into polymers, the monomers have such disadvantages that they, when added to silver halide emulsions, increase fog thereof, or when added to the protective layer thereof, deteriorate in antistatic, thus being not necessarily an excellent dispersing method.

An object of the present invention is to provide a silver halide photographic material which does not deteriorate in the antistatic thereof nor has any such disadvantageous influence upon photographic characteristics as high fog formation even in the application of hydrophobic materials.

The other object is to provide a new polymer loaded with a hydrophobic compound which is dispersed uniformly in a hydrophilic layer of a photographic material.

According to the present invention polymer latex obtained by copolymerizing a copolymerizable non-ionic hydrophobic monomer and at least one kind of monomers having the formula [I] is employed:

Formula [I]

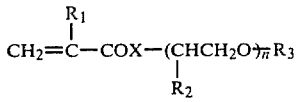

wherein $R_1$ and $R_2$ each is a hydrogen atom or methyl group, $R_3$ is a hydrogen atom or an organic radical, e.g., such a group as an alkyl or aryl group (e.g., methyl, ethyl, hexyl, phenyl, naphthyl, etc.), X is —O— or

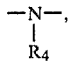

wherein $R_4$ is hydrogen, or an alkyl group, and n and m each is an integer of from 2 to 100.

The monomers composing the polymer latex of the present invention are generally hydrophilic, so that hydrophobic monomers are needed to be copolymerized in the formation of the polymer latex. The following are preferably usable typical examples of hydrophobic monomers:

(1) Methacrylic acid esters such as
ethyl acrylate, butyl acrylate, etc.
(2) Methacrylamides such as
N,N-diisopropyl acrylamide, butyl acrylamide, etc.
(3) Vinyl esters such as
vinyl acetate, vinyl butyrate, etc.
(4) Styrenes such as
α-chloromethyl styrene, vinyl toluene, etc.

Although the selection of the hydrophobic monomer composition copolymerizable with a compound having Formula [I] cannot be hastily determined according to intended characteristics due to the fact that the selection depends largely upon the nature of a monomer to be used, the composition containing monomers having Formula [I] should be from 0.1 to 40% by weight, preferably from 1 30% by weight.

Examples of compounds having Formula [I] are enumerated below, but are not limited thereto:

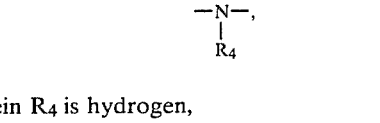

(1)

(2)

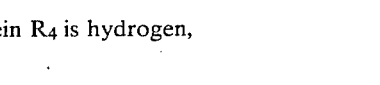

(3)

(4)

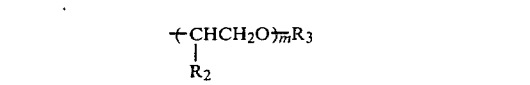

(5)

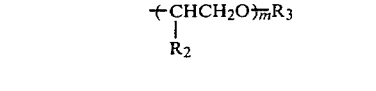

(6)

(7)

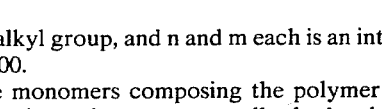

(8)

-continued (9)

(10)

(11)

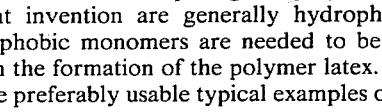

(12)

(13)

(14)

(15)

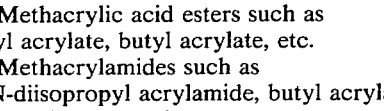

(16)

(17)

(18)

(19)

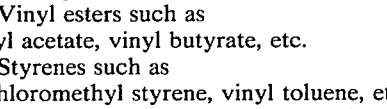

(20)

(21)

(22)

(23)

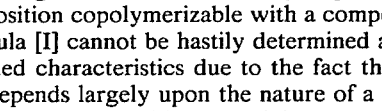

(24)

Further, preferred examples of polymer latex compositions usable in the present invention are enumerated below, but are not limited thereto.

(1)

n:m = 90:10

-continued (2)

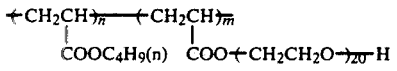

n:m = 95:5

(3)

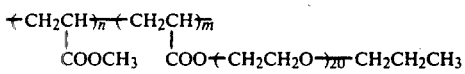

n:m = 85:15

(4)

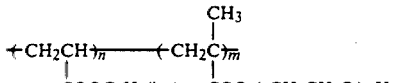

n:m = 90:10

(5)

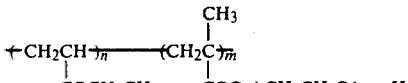

n:m = 95:5

(6)

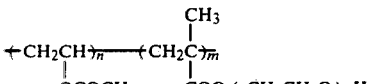

n:m = 93:7

(7)

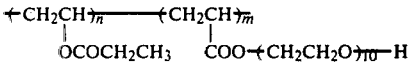

n:m = 91:9

(8)

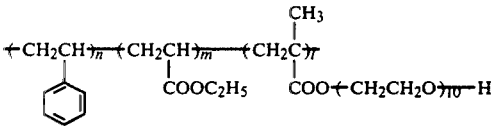

n:m:l = 50:45:5

(9)

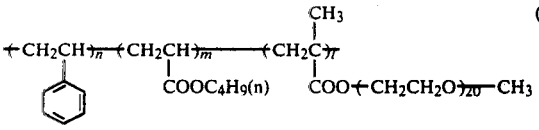

n:m:l = 30:65:5

(10)

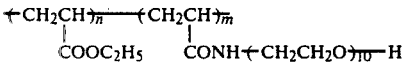

n:m = 90:10

(11)

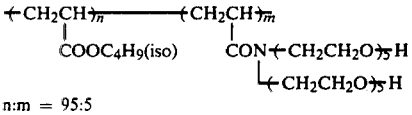

n:m = 95:5

(12)

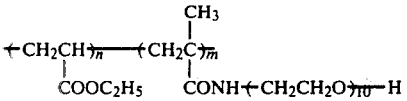

n:m = 90:10

-continued (13)

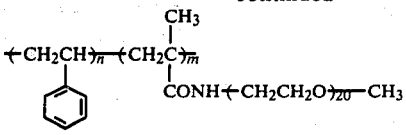

n:m = 98:2

(14)

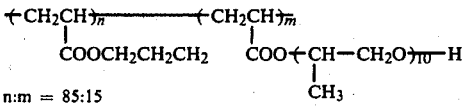

n:m = 85:15

(15)

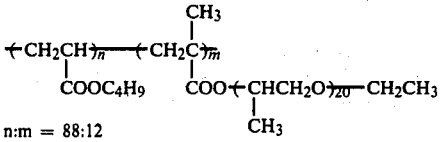

n:m = 88:12

The polymer latexes used in the present invention may be synthesized according to known methods, for example, in such a manner that to deaired distilled water are added, at need, a emulsifying agent, polymerization initiator, polymerization initiation accelerator, and polymerization control agent, then 10-60% by weight monomer, and the resulting mixture is heated to 40°-90° C. with stirring over a period of several hours. In such a procedure, if a monomer compound having Formula [I] is used, such an emulsifying agent as various surfactants need not be used, so that there may be avoided deteriorations of photographic characteristics such as, e.g., desensitization, the deterioration of antistatic effect and the like, arising when a polymer latex is added with the use of an emulsifying agent to a photosensitive material.

As preferred polymerization initiators used in the above-described synthesizing method there may be used water-soluble peroxides such as ammonium persulfate, potassium persulfate, hydrogen peroxide, and the like, while as preferred polymerization initiation accelerators, sodium hydrogensulfite and the like may be used, and further, if necessary, polymerization control agents such as mercaptan compounds and the like may also be added.

The following are synthesis examples of polymer latexes used in the present invention:

SYNTHESIS EXAMPLE 1

Synthesis of exemplified polymer latex compound (1): 700 g. of distilled water was put into 1 liter four-necked flask and heated to 80° C. introducing nitrogen gas thereinto. To this was added 1.5 g. of ammonium persulfate, and thereupon was added dropwise over a period of an hour a mixture of 270 g. of ethyl acrylate with 30 g. of exemplified monomer compound (2). After completion of the dropping the mixture was further stirred over a period of 4 hours, and thereafter was cooled down to room temperature. The polymer concentration, at the time of the synthesis, was 29.8% by weight, and the transmission in 0.5% by weight of the polymer at the wavelength of 670 nm was 85%.

SYNTHESIS EXAMPLE 2

Synthesis of exemplified polymer latex compound (4): Synthesis was performed in quite the same manner as in SYNTHESIS EXAMPLE 1 with the use of 30 g. of exemplified monomer compound (8) and 270 g. of isobutyl acrylate. The polymer concentration at the time of the synthesis was 28.3% by weight, and the transmission in 0.5% by weight at the wavelength of 670 nm was 90%.

Thus prepared polymer particles employed in the present invention may have diameters thereof from 0.01 to 1 micron. The preferable diameter of the particles are from 0.02 to 0.5 micron. Molecular weight effectively employable polymers is from 10,000 to 1,000,000.

The words hydrophobic compounds used in the present invention is applied to materials substantially water-insoluble at room temperature which are added to normal silver halide photosensitive materials. The "substantially water-insoluble" means a solubility of less than 1%. Typical examples of these hydrophobic compounds include dye forming agents, ultraviolet absorbing agents, development inhibitor releasing compounds, cross oxidation type dye releasing agents, brightening agents, antihalation or antiiradiation agents, sensitizing dyes, developing agents, and the like.

More particularly, hydrophobic dye forming agents include, for example, open chain methylene series yellow couplers, 5-pyrazolone series magenta couplers, phenol or naphthophenol series cyan couplers, and the like. These couplers may be either the so-called two-equivalent or four-equivalent couplers, and in combination with them there may also be used for the purpose of automasking azo type colored couplers, osazone type compounds, diffusible dye releasing couplers, and the like. Further, in order to improve photographic characteristics there may be included in the use in combination with various couplers the so-called competing couplers, DIR couplers (Development Inhibitor Releasing Couplers). BAR couplers (Bleach Accelerator Releasing Couplers), and the like. As yellow couplers there have heretofore been effectively used open chain ketomethylene compounds such as, e.g., pivalylacetanilide type yellow couplers in U.S. Pat. No. 3,265,506, benzoylacetanilide type yellow couplers in British Pat. No. 1,240,600 and in U.S. Pat. No. 2,875,051. Besides, active site-O-aryl substituted couplers, the so-called two-equivalent couplers in U.S. Pat. No. 3,408,194, active site-O-amyl substituted couplers in U.S. Pat. No. 3,447,928, active site hydantoin compound substituted couplers in British Pat. No. 1,351,424, active site urazole compound substituted and active site succinic acid imide compound substituted couplers in British Pat. No. 1,331,179, active site monoxisoimide compound substituted and active site fluorine substituted couplers in British Pat. No. 94,490, active site chlorine or bromine substituted couplers in British Pat. No. 780,507, active site-O-sulfonyl substituted couplers in British Pat. No. 1,092,506, and the like may also be used as effective yellow couplers.

Magenta couplers usable in the present invention include such compounds as pyrazolone series, pyrazotriazole series, pyrazolinobenzimidazole series, indazolone series compounds. As pyrazolone series magenta couplers there may be used those which are described in U.S. Pat. Nos. 3,127,269, 2,600,788, 3,519,429, 3,419,391 and 3,062,653, British Pat. Nos. 1,342,553 and 1,399,306, and U.S. Pat. No. 3,684,514; as pyrazotriazole series magenta couplers, those in British Pat. No. 1,247,493; as pyrazolinobenzimidazole series magenta couplers, those in U.S. Pat. No. 3,061,432; and as indazolone series magenta couplers, those in British Pat. No. 1,335,603.

Magenta couplers most suitably usable in the present invention include those which are described in U.S. Pat. Nos. 3,684,514 and 3,127,269.

Cyan couplers effectively usable in the present invention include, for example, phenol compounds described in U.S. Pat. Nos. 2,423,730, 2,801,171 and 2,895,826; active site-O-aryl substituted naphthol compounds described in U.S. Pat. No. 2,474,293, and British Pat. No. 1,084,480; phenol and naphthol compounds in Canadian Pat. No. 913,082, and U.S. Pat. No. 3,737,316.

As colored magenta couplers there may be used such compounds produced by substituting colorless magenta couplers with arylazo or heteroarylazo at the active site thereof as described in, e.g., U.S. Pat. Nos. 3,005,712, 2,983,608 and 2,801,171, British Pat. No. 937,612, and U.S. Pat. No. 3,684,514.

As colored cyan couplers there may be used such active site arylazo substituted compounds as described in U.S. Pat. Nos. 3,034,892 and 2,521,908, British Pat. No. 1,255,111, and U.S. Pat. No. 3,811,892, and besides, there may also be used such masking couplers of the type the dye formed therefrom is reacted with the oxide of a developing agent to run into the developing solution as described in British Pat. No. 1,084,480.

As competing couplers there may be used those described in U.S. Pat. No. 2,742,832 such as, for example, citradinic acid and the like, and as wise couplers those described in U.S. Pat. No. 2,998,314 may be used.

As development inhibitor releasing substances those in U.S. Pat. Nos. 3,632,345, 3,632,345, 3,928,041, 3,958,993 and 3,961,959 may be favorably used.

As ultraviolet absorbing agents those described in U.S. Pat. Nos. 3,687,671, 3,706,700, 2,739,888, 3,652,284, 3,468,897, 3,004,896 and 3,253,921 are applicable.

Other usable hydrophobic compounds include those described in U.S. Pat. Nos. 2,751,298 and 3,506,443, Canadian Pat. No. 602,607, U.S. Pat. Nos. 3,443,939, 3,443,940, 3,443,941, 3,725,062, 3,415,644, 3,415,645, 3,415,646, 3,647,437 and 3,635,707, and further, those hydrophobic developing agents described in U.S. Pat. Nos. 3,801,321, 3,672,896, 3,679,426, 3,672,904 and 3,751,249 are also applicable to the present invention.

In addition, such photographic materials as described in Product Licensing Index Vol. 92 (1971) 110.

The "dispersing the hydrophobic material into the polymer latex" previously phrased in this invention means such condition that the hydrophobic material is dissolved in or absorbed on the surface of the polymer particle in the form of polymer latex dispersed in water, and the hydrophobic substance itself is not aggregated nor crystallized. Methods for the dispersion of hydrophobic materials into polymer latexes are described in, for example, Japanese Patent Open to Public Inspection (hereinafter referred to as Japanese Patent O.P.I. Publication) Nos. 59942/1976, 59943/1976 and 32552/1979.

According to the above-described publications, an objective product is obtainable in such a procedure that a polymer latex, hydrophobic material and water-miscible low boiling organic solvent such as, e.g., acetone, methanol, ethanol, tetrahydrofuran, etc. are mixed, and then the low boiling solvent is removed from the mixture, or in another procedure such that in the synthesis of a polymer latex the copolymerization reaction is effected after dissolving a hydrophobic material in a monomer, and the hydrophobic material is incorporated into the polymer latex concurrently with the synthesis thereof.

The polymer concentration in the polymer latex containing a hydrophobic material may be selected arbitrarily, but in general the concentration should be from 1% to 30% by weight, most preferably from 3% to 10% by weight. The added amount of the hydrophobic material for dispersion should be from 0.1 to 10 times the amount of the polymer, preferably from 1 to 3 times. The added amount of the water-miscible solvent concurrently used is preferred to be from 0.1 to 1 time the whole amount of the polymer latex, but should be varied according to the composition of the latex polymer or the hydrophobic material used.

The polymer latex containing the thus obtained hydrophobic material dispersed therein may be incorporated into the component layers of a photosensitive material according to the purpose, but the component layers mentioned in the present invention mean such layers as ranging from silver halide photosensitive emulsion layers, protective layers, interlayers, antihalation layers to ultraviolet layers and the like. It is preferred generally the hydrophobic material be incorporated into such component layers as can fully display its effects.

The effect in the case is where a color forming agent, i.e. the hydrophobic material of the present invention dispersed in the polymer latex of the present invention, because the polymer latex exhibits less oozing out to the surface of the sensitive layer than the high boiling solvent does, is found out to be much improved in the color developability as compared to that in the conventional method in which a color forming agent dissolved in a high boiling solvent is dispersed in the photosensitive layer.

The above-mentioned advantage is significant in the use of the polymer latex produced from the monomer having in the molecule thereof a polyethylene oxide group, the advantage being considered brought about by the color development accelerating effect due to the polyethylene oxide.

Further, the use of the polymer latex of the present invention not only curbs the occurrence of fog but improves the color purity and durability of color developed images.

The present invention is illustrated in further detail in reference to examples below:

EXAMPLE 1

To 100 ml. of 10% by weight in polymer concentration of polymer latex exemplified compound (1) synthesized in Synthesis Example 1 was added dropwise spending about ten minutes with stirring a solution of 5 g. of an yellow dye forming coupler, α-(3-benzyl-2,4-dioxy-imidazolizine-3-yl)-2-pivaloyl-5-[α'-(2,4-di-tert-aminophenoxy)butylamide]-2-chloroacetanilide dissolved in 100 ml. of acetone, and after continuing the stirring for another ten minutes the acetone was removed under reduced pressure. A sample from the thus obtained product was examined with a microscope and no deposition of the coupler was observed.

EXAMPLE 2

The same latex and coupler as in the case of Example 1 were used. Acetone was added to the latex, and to the mixture with stirring was added at a time the coupler. After continuing the stirring for another ten minutes the acetone was removed under reduced pressure. The resulting product was examined under a microscope and no deposition of crystals of the coupler was observed.

EXAMPLE 3

50 g. of the same coupler as that used in Example 1 was dissolved in the same monomer as was used in Synthesis Example 1, and with the mixture a polymer latex was synthesized in quite the same manner as in Synthesis Example 1. No deposition of coupler was observed, thus yielding a stable latex liquid with 32% by weight solid concentration and 65% transmission in 0.5% by weight at the wavelength of 670 nm.

EXAMPLE 4

A polymer latex-coupler additive was produced in quite the same manner as in Example 2 with the use of a magenta dye forming coupler, 1-(2,4,6-trichlorophenyl)-3-(2-chloro-5-octadecyl-succinimideaniline)-pyrazoline-5-one, 30 ml. of tetrahydrofuran, and exemplified polymer latex compound (4). The results were identical with those in Example 2.

EXAMPLE 5

5 g. of a cyan dye forming coupler, 2-[α-(2,4-di-tert-amylphenoxy)butylaminde]-4,6-dichloro-5-methylphenol and 5 g. of dimethyl phthalate were dissolved in 15 ml. of ethyl acetate. The solution was mixed with 75 ml. of 35% aqueous gelatin solution (containing Alkanol XC as a dispersant, sodium alkyl naphthalene sulfonate, manufactured by Du Pont), and then the mixture was subjected to an ultrasonic dispersion treatment in an ordinary manner thus to yield a dispersed liquid (A). Subsequently 50 ml. of the polymer described in Japanese Patent O.P.I. Publication No. 59943/1976, sodium n-butyl acrylate-3-methacryloyloxypropane-1-methyl-1-sulfonate-2-acetoacetoxyethyl methacrylate copolymer (85:10:5) (polymer concentration: 20%) were used as a polymer latex, and this was impregnated with 5 g. of the foregoing cyan dye forming coupler, thereby producing a dispersed liquid (B). Further, 50 ml. of exemplified polymer latex compound (1) (polymer contentration: 20%) and 5 g. of the foregong cyan dye forming coupler were used and an impregnation of them was made in the same manner as in Example 2, whereby a dispersed liquid (C) was obtained.

The thus produced respective three dispersed liquids were separately mixed with a silver halide emulsion for red-sensitive photographic paper use, and the resulting emulsion were coated on photographic film base respectively, the results of which are shown in Table 1 below:

TABLE 1

| | Control 1 | Control 2 | Sample 1 of the present invention |
|---|---|---|---|
| Coupler-impregnated polymer latex | A | B | C |
| Quantity of coupler mg/dm$^2$ | 7.5 | 7.6 | 7.4 |
| Quantity of silver mg/dm$^2$ | 4.0 | 4.1 | 4.0 |
| Quantity of gelatin mg/dm$^2$ | 38.5 | 39.0 | 38.9 |

Samples A, B and C were exposed to light respectively and processed in a usual manner in the following developing bath for 4 minutes at 25° C.

| Composition of the developing bath used: | |
|---|---|
| 2-methyl-4-(N—ethyl-N—β-methanesulfonimidethylamino)aniline 3/2 sulfate | 4.5 g. |
| Potassium bromide | 2.0 g. |
| Sodium carbonate, monohydrated | 20.0 g. |
| Sodium sulfite | 3.0 g. |
| Hydroxylamine sulfate | 2.0 g. |
| Sodium hexametaphosphate | 2.0 g. |
| Benzyl alcohol | 10.0 ml. |
| Water to make 1 liter | |
| pH: 10.1 | |

The obtained results are shown in Table 2.

TABLE 2

| | Relative speed | Dmax | Gamma | Dmin |
|---|---|---|---|---|
| Control 1 | 100 | 2.50 | 3.10 | 0.06 |
| Control 2 | 95 | 2.40 | 3.00 | 0.07 |
| Sample 1 | 99 | 2.58 | 3.09 | 0.03 |

As apparent from the above table, the sample of the present invention shows a significantly low Dmin. as compared to the control samples, and is by no means inferior in other characteristics to conventional methods.

What is claimed is:

1. A silver halide photographic material having a hydrophilic colloid layer comprising fine polymer particles loaded with a hydrophobic photographic addenda provided on a support wherein the polymer of the polymer particles have repeating units formed from a nonionic hydrophobic monomer and a monomer having the formula [I]:

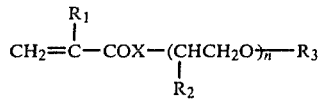

[I]

wherein X is

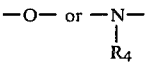

, $R_4$ is an alkyl group or

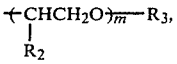

$R_1$ and $R_2$ individually are a hydrogen atom or methyl group, $R_3$ is a hydrogen atom, an alkyl or aryl group, and m and n are integers of from 2 to 100 individually.

2. A silver halide photographic material according to claim 1 wherein the polymer particles are prepared according to emulsion polymerization.

3. A silver halide photographic material according to claim 1 wherein the polymer particles are of from 0.01 to 1 micron in diameter.

4. A silver halide photographic material according to claim 1 wherein an amount of the repeating unit forms from the monomer having the formula [I] is from 0.1 to 40 weight percent of the polymer.

5. A silver halide photographic material according to claim 1 wherein the nonionic hydrophilic monomer is selected from a group consisting of methacrylesters, methacrylamides, vinylesters and stylenes.

6. A silver halide photographic material according to claim 1 wherein the hydrophobic addenda is a dye forming coupler, a UV absorbing agent, a DIR compound, a whitening agent, an antihalation agent, a sensitizing dye, a desensitizing dye or developing agent.

7. A silver halide photographic material according to claim 6 wherein the hydrophobic addenda is a dye foming coupler or a UV absorbing agent.

* * * * *